US005113040A

United States Patent [19]

Hose et al.

[11] Patent Number: 5,113,040

[45] Date of Patent: May 12, 1992

[54] FLEXIBLE ELECTRICAL CABLE HAVING TWO STRANDED CONDUCTORS

[75] Inventors: Fritz Hose, Ahorn; Thomas Reuss, Coburg, both of Fed. Rep. of Germany

[73] Assignee: Siemens Aktiengesellschaft, Berlin & Munich, Fed. Rep. of Germany

[21] Appl. No.: 654,787

[22] Filed: Feb. 13, 1991

[30] Foreign Application Priority Data

Feb. 13, 1990 [DE] Fed. Rep. of Germany ... 9001823[U]

[51] Int. Cl.[5] ..... H01B 7/02

[52] U.S. Cl. ..... 174/116; 174/113 R

[58] Field of Search ..... 174/116, 113 R

[56] References Cited

U.S. PATENT DOCUMENTS

| | | | |
|---|---|---|---|
| 2,119,393 | 5/1938 | Lewis et al. | 174/116 |
| 2,718,544 | 9/1955 | Shepp | 174/113 R |
| 3,602,636 | 8/1971 | Evans | 174/115 |
| 3,699,238 | 10/1972 | Hansen et al. | 174/116 X |
| 3,829,603 | 8/1974 | Hansen et al. | 174/116 X |
| 4,002,820 | 1/1977 | Paniri et al. | 174/116 X |

FOREIGN PATENT DOCUMENTS

| | | | |
|---|---|---|---|
| 30555 | 10/1922 | Denmark | 174/116 |
| 2616069 | 10/1977 | Fed. Rep. of Germany | 174/113 R |

*Primary Examiner*—Morris H. Nimmo
*Attorney, Agent, or Firm*—Kenyon & Kenyon

[57] ABSTRACT

A flexible electrical cable includes two stranded, rubber-insulated conductors. A rubber sheathing surrounds the conductors and it includes an inner and outer sheathing. The rubber sheathing and the two conductors form interstices therebetween. A wide-meshed textile plait is arranged between the inner sheathing and the outer sheathing. Cable fillers are arranged in the interstices. The cable fillers each have a section-forming rubber stand with a tension-proof element embedded therein. A braided covering of a latticed binding surrounds the conductors and the cable fillers.

6 Claims, 1 Drawing Sheet

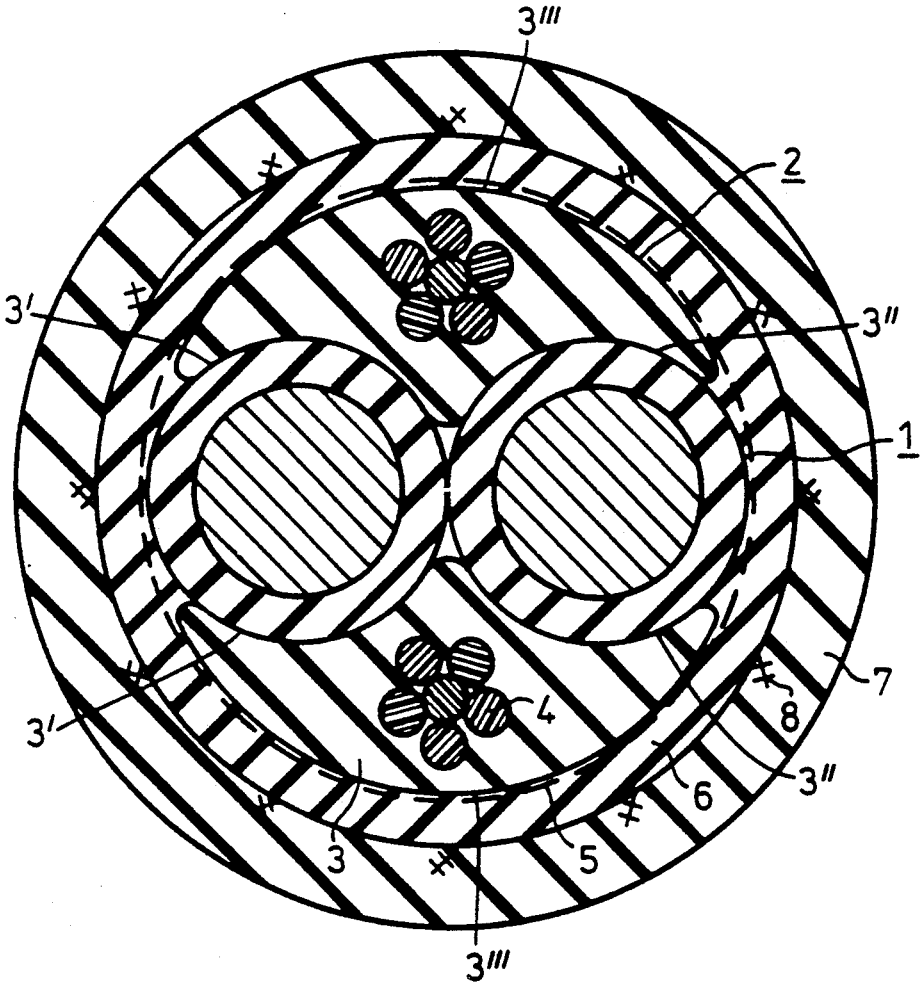
3'''
2
3'
3''
1
7
8
4
3'
6
3''
3
5
3'''

FLEXIBLE ELECTRICAL CABLE HAVING TWO STRANDED CONDUCTORS

BACKGROUND OF THE INVENTION

The present invention relates generally to electrical cables and leads and more particularly to a flexible electrical cable.

Such a cable has two stranded conductors, two cable fillers and one rubber sheathing. These types of cable leads are used to supply current to two-pole, mobile device that consumes electricity such as the magnet of a lifting-magnet-type crane.

A two-conductor electrical cable used to supply current to a mobile device, such as a tool or a movable machine part, is disclosed in U.S. Pat. No. 2,900,437. This known cable has good flexibility, a high resistance to stress resulting from impacts, good tensile strength and resistance to strain caused by bending. The cable is constructed from two conductors which are stranded together. Each conductor includes a high-tensile fibrous core, fine copper wires wound onto this core, a braided covering of textile fibers, and a two-layer insulation of rubber. The two stranded conductors may be surrounded by an inner sheathing, which also fills in the interstices between the strands of the conductors. Alternatively, the interstices are filled with a fibrous filling material. Above this layer is a braided covering of textile fibers and an outer sheathing of rubber.

Another known two-conductor flexible cable for supplying current to portable devices is disclosed in U.S. Pat. No. 2,186,793. In this known conductor the interstices are filled with a cable filler made of rubber or textile fibers. Alternatively, the interstices are filled with a rubber strand which expands, producing an insulating foam when the cable is vulcanized. The conductors have only one lead and one rubber insulation layer, and the cable has a simple rubber sheathing.

Additionally, in German Printed Patent 20 39 870, the interstices in a two-conductor cable are filled with sectional elements. The boundary of the sectional elements in the plane of the cable cross-section form circular segments. These circular segments are adapted to fit the contour of the two stranded conductors and the inner contour of the inner sheathing. In this case, the cable fillers are manufactured as one piece with the conductor insulation.

The problem with the prior art is that it does not provide a flexible electrical cable that is simple to construct, that is tension-proof and capable of withstanding impacts and high dynamic stresses such as occur in cables supplying current to the magnet of a lifting-magnet-type crane.

SUMMARY OF THE INVENTION

The present invention provides a flexible electrical cable that includes two stranded, rubber-insulated conductors. A rubber sheathing surrounds the conductors and it includes an inner and outer sheathing. The rubber sheathing and the two conductors form interstices therebetween. A wide-meshed textile braid is arranged between the inner sheathing and the outer sheathing. Cable fillers are arranged in the interstices. The cable fillers each have a section-forming rubber strand with a tension-proof element embedded therein. A spun covering of a open mesh tape surrounds the conductors and the cable fillers.

A cable constructed in this manner assures a high degree of tensile strength due to the adequate flexibility provided by the specially formed cable fillers. The cable also has the capacity necessary to resist transverse forces such as occur when the cable is uncoiled under stress. This resistance to transverse forces results from the compact construction of the cable and the shielding of the cable fillers by the inner sheathing. The cable also provides effective torsional protection due to the generally known refinement of the sheathing. Following the cable construction known from the German Printed Patent 20 39 870, the section-forming rubber strand of each cable filler is advantageously formed so that its cross-sectional boundary makes up circular segments, which are adapted to fit either the contour of the two stranded conductors or the inner contour of the inner sheathing. As a result, the interstices are optimally filled and the tension-proof elements are fixed in position.

BRIEF DESCRIPTION OF THE DRAWING

The sole Figure shows a cross-sectional view of the cable constructed according to the principles of the invention.

DETAILED DESCRIPTION

A cross-sectional view of the electrical cable of the invention is shown in the Figure. Two conductors 1, which each include one stranded conductor with rubber insulation, are stranded together with two cable fillers 2 to form a core assembly. Each cable filler 2 includes a rubber strand 3 having a centrally embedded bearing part 4, which is made up of several non-stranded, high-tensile plastic filaments. The boundary of each rubber strand 3 in the cross-sectional plane forms circular segments, some of which are adapted to fit the contour of the two conductors 1, 3' and 3'', and another of which is adapted to fit the inner contour of the inner sheathing 6 that is arranged thereabove, 3'''.

The core assembly conductors 1 and cable fillers 2 is first surrounded by a spun covering 5 of a open mesh tape. Above (i.e. outside) the covering 5 is the inner sheathing 6, which is made of rubber and which grips the core assembly through interstices of the open mesh tape 5. A braid 8, which provides torsional protection and is made of textile filaments such as twisted polyester threads, is applied to the inner sheathing 6. Above the braid 8 is an outer sheathing 7 made of rubber.

What is claimed is:

1. A flexible electrical cable comprising:

two stranded, rubber-insulated conductors;

a rubber sheathing surrounding said conductors, said rubber sheathing including an inner and outer sheathing, said rubber sheathing and said two conductors forming interstices therebetween;

a wide-meshed textile braid arranged between said inner sheathing and said outer sheathing;

cable fillers arranged in said interstices, said cable fillers each having a section-forming rubber strand with a tension-proof element embedded therein; and a spun covering of a open mesh tape surrounding said conductors and said cable fillers.

2. The flexible electrical cable of claim 1 wherein each cable filler has a cross-sectional boundary forming circular segments.

3. The flexible electrical cable of claim 2 wherein each cable filler has first and second circular segments adapted to fit a contour of said two stranded conductors.

4. The flexible electrical cable of claim 3 wherein each cable filler has a third circular segment adapted to fit an inner contour of said inner sheathing.

5. The flexible electrical cable of claim 2 wherein each cable filler has a circular segment adapted to fit an inner contour of said inner sheathing.

6. A flexible electrical cable resistant to transverse forces that occur when said cable is coiled or uncoiled, comprising:

two stranded, rubber-insulated conductors;

a rubber sheathing surrounding said conductors, said rubber sheathing including an inner and outer sheathing, said rubber sheathing and said two conductors forming interstices therebetween;

a wide-meshed textile braid arranged between said inner sheathing and said outer sheathing;

cable fillers arranged in said interstices, the cross-section of each cable filler having first and second circular segments adapted to fit a contour of said two stranded conductors and a third circular segment adapted to fit an inner contour of said inner sheathing, said cable fillers each having a section-forming rubber strand with a tension-proof element embedded therein, said tension-proof elements each formed by a plurality of non-stranded, high-tensile plastic filaments; and a spun covering of an open mesh tape surrounding said conductors and said cable fillers.

* * * * *